US005339717A

United States Patent [19]

Vagias

[11] Patent Number: 5,339,717

[45] Date of Patent: Aug. 23, 1994

[54] KEYBOARD INSTRUMENT HAVING SOUNDBOARD WITH UNCONSTRAINED EDGES

[76] Inventor: Ernest Vagias, 265 Prospect St., Baden, Pa. 15005

[21] Appl. No.: 851,066

[22] Filed: Mar. 13, 1992

[51] Int. Cl.[5] ..... G10C 3/06

[52] U.S. Cl. ..... 84/192; 84/195; 84/196; 84/294

[58] Field of Search ..... 84/192, 193, 194, 195, 84/196, 294

[56] References Cited

U.S. PATENT DOCUMENTS 591,759 10/1897 Hambloch .
750,248 1/1904 Brashears .
1,351,709 8/1920 Virzi .
3,757,026 9/1973 Carbone .
3,785,237 1/1974 Schutze .

*Primary Examiner*—Michael L. Gellner
*Assistant Examiner*—Cassandra Spyrou
*Attorney, Agent, or Firm*—Clifford A. Poff

[57] ABSTRACT

To obtain a smaller piano having a larger piano sound, there is constructed a piano having a modified construction in reference to its sounding board and the means for mounting it. Instead of being provided with the usual eight to ten strengthening ribs on its back side and having all of its four edges entirely secured to the piano case, the sounding board in the modified construction of the invention is mounted so that it has, in effect, a greater opportunity to float, in that it has at least one opposed pair of edges which are at least in major part, if not entirely, unconfined, and there are used to maintain its crown some lesser number, such as three or only one, of strengthening ribs, major reliance for maintaining the crown being placed upon a centrally situated wood or metal wedge member.

9 Claims, 1 Drawing Sheet

KEYBOARD INSTRUMENT HAVING SOUNDBOARD WITH UNCONSTRAINED EDGES

BACKGROUND OF THE INVENTION

1. Field of the Invention

This invention relates to an apparatus for the production of musical tones, and in particular, it relates to instruments of the keyboard type, especially instruments in the nature of the acoustic (non-electrical) piano. Still more particularly, it has reference to the sounding board of such an instrument and the parts of the instrument which are adjacent thereto or in contact therewith. The invention is concerned with the objective of obtaining, especially from an instrument of relatively more modest size and cost, such as a spinet, the desirable tones, high in amplitude and with long decay-time characteristic, a characteristic that can also be enhanced in a far larger and most costly instrument, such as a concert grand piano.

2. Description of the Prior Art

Acoustic pianos are made, as is well known, in the a spectrum of styles or sizes, ranging from the lowly spinet through the console and the upright to baby grand and concert grand. They all operate on the same principles, creating musical tones of audible amplitude in desired frequencies (pitches) by providing a keyboard means which can be activated to cause a hammer means to strike, when a key is depressed, a vibrator means (a tuned string or strings), and when the key is released, to cause a damper means to come into contact with the vibrator means. The tuned strings are located in close proximity to a sounding board which is caused to resonate by the energy emitted from the vibrator means and thereby mechanically amplify and broadcast the tones emanating from the vibrator means.

Historically and extending to current times, piano sounding boards have been anchored to the piano harp and the perimeter of the piano case. Bridges (such as tenor, treble and bass) are attached to the sounding board, and the strings stretch over and bear down upon the bridges. The sounding boards are designed with a crown, convex in shape when viewed from the front of the piano, and in most cases, this crown is strengthened and maintained by means of ribs which are glued to the back of the sounding board to ensure that the crown will not flatten out. Maintenance of the crown is critically necessary, because if, as the piano ages, it loses its crown, the strings lose their initial and desirable high degree of downbearing upon their associated bridges, and as a result, the piano loses its "bark", producing a dull sound, rather than the bright and crisp sound that it had when new.

The desire to obtain a larger-piano sound out of a smaller piano has existed in the art for about two centuries, but in recent decades, the emphasis has largely been upon trying to achieve this by means of the various new electrical or electronic devices (microphones and other transducers, amplifier, and speakers) as they have been invented. An example of this approach is contained in my U.S. Pat. No. 3,407,694, issued Oct. 29, 1968. In the structure shown in the patent, there are two sounding boards, each of which possesses a free edge, but it evinces and suggests nothing of the concept of the present invention, wherein an effort is made to produce an instrument having a sounding board with at least one pair of opposed edges which are in major part unconfined and thus more readily excitable to a desirable greater amplitude, and to produce natural sounds free of distortions commonly introduced by an electromechanical transducer equipment.

BRIEF DESCRIPTION OF THE DRAWINGS

The features and advantages of the present invention as well as other will be more fully understood when the following description is read in light of the accompanying drawings of which.

DESCRIPTION OF THE PREFERRED EMBODIMENTS

Figure 1:
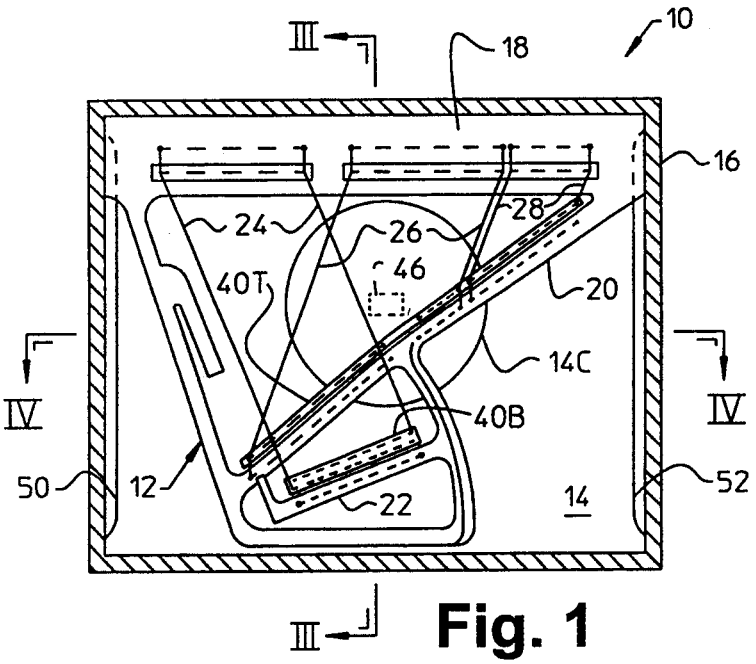
FIG. 1 is a schematic front view illustrating the internal construction of an upright piano incorporating the arrangement of a sounding board and associated members in accordance with the present invention.
Figure 3:
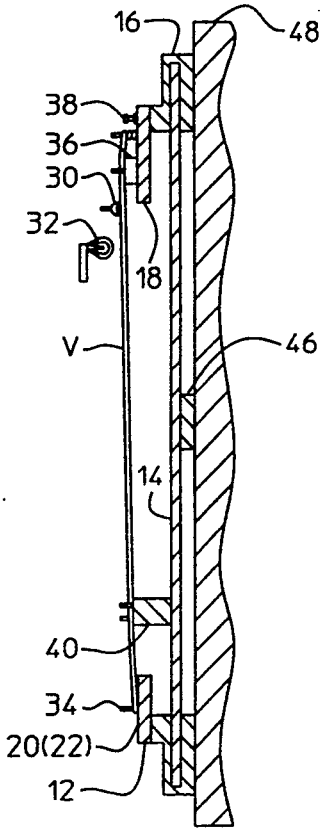
FIG. 3 is a sectional view taken along lines III—III of FIG. 1.
Figure 2:
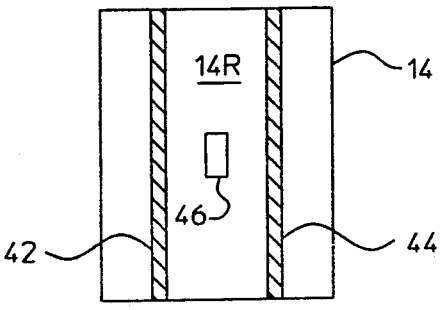
FIG. 2 is a rear elevational view of the sounding board as shown in FIG. 1.
Figure 4:
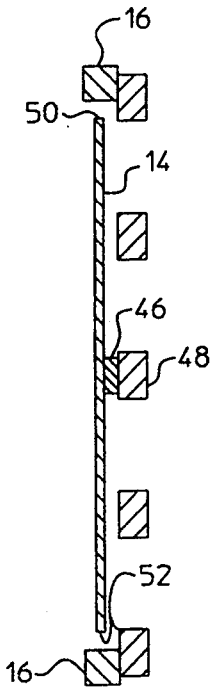
FIG. 4 is a sectional view taken along lines IV—IV of FIG. 1.

Referring to FIGS. 1–3 of the drawings, there is illustrated an upright piano 10 which includes a metal harp 12, a resonator or sounding board 14 mounted according to the present invention at peripheral locations to a frame 16 of the piano housing. The metal harp 12 is secured to the frame 16 at various points, as is conventional. The harp 12 includes an upper harp portion 18, an intermediate harp portion 20 and a bottom harp portion 22. Extending between these harp portions 18, 20 and 22, is a plurality of bass vibrators 24, a plurality of tenor vibrators 26, and a plurality of treble vibrators 28.

Referring now in particular to FIG. 3, a single tuned vibrator is illustrated and designated generally by the letter V. A damper 30 is shown which dampens the vibrator V. A hammer 32 is also illustrated and causes the tuned vibrator V to vibrate. The dampers 30 as well as the hammers 32 are incorporated into action elements and a keyboard both of which are not illustrated or described herein inasmuch as they are conventional.

In general, each tuned vibrator V is connected to a hitch pin 34 at one end and extends over a rib 36 and is connected to a tuning pin 38 at its opposite end. Tuning of the tuning pin 38 will, of course, alter the tension of the vibrator V and, hence, its frequency of vibration. Each tuned vibrator V also contacts a bridge 40 which is affixed to the sounding board 14. The bridge 40 serves to transmit the vibrations of the tuned vibrator V to the sounding board 14. By means of the bridge 40, the sounding board 14 is coupled to the tuned vibrator V and is therefore adapted to radiate sound in accordance with the vibrations of the tuned vibrator V. The bass vibrators 24 contact a bass bridge 40B, while the tenor and treble vibrators 26 and 28 contact a treble bridge 40T. The bridges 40B and 40T are secured to the sounding board 14.

In accordance with the invention and as shown in FIG. 2, the sound board 14 is provided on its rear face 14R with a suitable number of strengthening ribs, such as the ribs 42 and 44. In accordance with the invention, there are preferably used some relatively low number of ribs, such as one to three of them.

Although the sounding board 14 is shown for the purposes of simplicity in FIG. 2 as being merely rectangular, it is to be understood that the middle part thereof identified by reference numeral 14C, is formed convexly to constitute a crown. This is the crown mentioned hereinabove which must be maintained in order that the piano may retain over a long period of use its pristine "bark" or bright, crisp tone, caused by the production and maintenance of an optimal degree of downbearing by the strings against the bridges 40B and 40T. For maximal excitation of the sound board 14, it is important that the strings bear against the bridges as strongly as possible without incurring undue risk of having the strings break upon being impacted by their associated hammer means.

FIG. 1 also indicates the wedge or arresting member 46, which may be of wood or metal and is located centrally of the sounding board 14 and, in the embodiment depicted in FIGS. 1–4. The wedge or "arresting" member may take the form of a small block of wood or metal interposed between sound board and back post at a most convenient site to provide optimum "bulge" or crown in sound board and serves the important purpose of assisting the sounding board 10 to maintain its crown. At the same time, the wedge or arresting member 46 by connecting the sounding board 14 to the back post 48 of the piano and allowing at least opposed edge portions free to vibrate at a large amplitude.

As shown by illustrations of FIGS. 1–3, it is important the sounding board possess at least one pair of edges, preferably a pair of opposed edges such as the edges 50 and 52, which are permitted, at least in a major part if not entirely, to remain unconfined—that is, spaced out of contact with frame 16 in order that the amplitude of the vibrations made by the sounding board 14 shall be relatively greater than they would be if the sounding board were, like the ones of the prior art, connected or attached to the frame throughout the entire periphery thereof. As shown in FIG. 1, the edges 50 and 52 extend into supporting engagement with the frame 16 at each corner portion along the side edges. Preferably, it is desired that the sounding board be solidly attached to the frame 16 from end to end at the top and on the bottom of the board. The construction would thus have a maximum "float" on the left and right sides of the sounding board as seen from FIGS. 1 and 4. Greater amplitude of sounding-board vibration means louder emitted tones and longer decay times, which are features which distinguish the performance of larger and more costly pianos from that of instruments of more modest dimensions.

Whereas an upright or grand piano sounding board is anchored about the entire periphery of the piano superstructure, the sounding board piano of the present invention is anchored at the top and at the bottom of the piano structure. The left and right sides of the sounding board are unconfined to the frame thus permitting greater flexibility of the sounding board. Greater flexibility of the sounding board, or amplitude, will move a larger volume of air at greater pressure. The piano will thereby produce a louder sound but even more, the increase of amplitude will provide a slower rate of decay. The "loudness" and "decay" factors will produce more audible harmonics which are the embellishment of fundamental sound, the essence of music. Any arrangement of open gaps will enhance the flexibility of the sounding board whether there be 2 gaps or 4 gaps or more. The restraining element (block of wood or metal) positioned between sound board and back post and firmly pressing against board and back post will assure that the established crown will be maintained. A stable crown is imperative.

Figure 5:
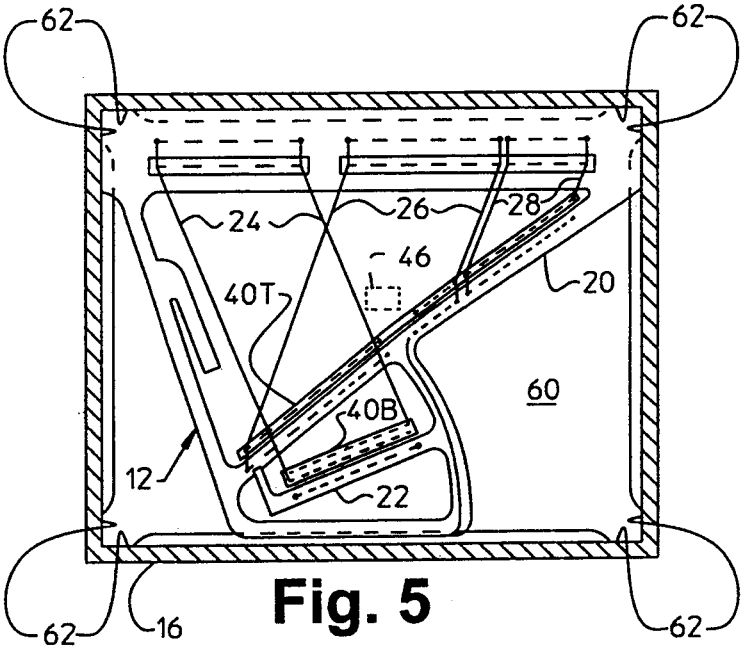
FIG. 5 is a schematic front view similar to FIG. 1 and illustrates alternative embodiment of the invention.

In illustration of an alternative possibility, there may be considered, with respect to the degree and extent of attachment of the sounding board to other parts of the piano, the possibility which is illustrated in FIG. 5. In FIG. 5, there is a sound board 60, which is shown as a rectangle, and it will be understood as having, for example, the same bridges, ribs, and wedge member identified by the same reference numeral as described in regard to FIGS. 1–4, for connection to the middle post of the piano. The sound board 60 is secured to the frame 16 essentially only at corner extension portions 62 which are projecting portions at the respective four corner areas of the sounding board. The wedge or arresting member 46 is also at the same time so dimensioned and positioned that it contacts the central area of the sounding board for constrained support while the peripheral edge portion between the corner supports can vibrate to large amplitude as the embodiment of FIGS. 1–4, the wedge or arresting member.

One physical distinction between pianos of the smaller kind (spinet, console, or upright) and those of the large kind (baby grand, concert grand) is that in the case of the former, the sounding board and the adjacent harp are oriented substantially vertically, wherein the latter, there are oriented horizontally. The present invention provides the advantage of obtaining en-housed sound or more amplitude from pianos of the kind having a sounding board which is oriented vertically or horizontally. Moreover, the present invention is applicable to acoustic stringed instruments including guitars, violins, violas, basses, harpsichords and zithers. The invention is not applicable to string instruments having a solid body such as is found in electronic guitars and basses.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A musical instrument having a plurality of individually tunable strings for producing sound by vibration thereof, means including a keyboard for selectively activating and damping said strings, a bridge means and sound board means operatively connected to said bridge means over which said plurality of strings pass and located adjacently to said plurality of strings for radiating sound in response to vibration of said plurality of strings, said sounding board means having at least one pair of edges which are in major part unconfined and free to vibrate by said bridge means mounted on said sounding board in response to activation by string vibrations to a greater loudness and slower decay rate as a result of said unrestrained pair of edges, said sounding board means including means, centrally located with respect to said sounding board means, for mounting said sounding board means to a structural part of said instrument.

2. The musical instrument according to claim 1, wherein said instrument comprises a piano, the means for selectively activating said strings comprising a plurality of hammer means.

3. The musical instrument according to claim 1, wherein said instrument comprises a harpsichord, the means for selectively activating said strings being a plurality of means of plucking said strings.

4. A musical instrument according to claim 1, wherein said mounting means centrally located with respect to said sounding board means includes a wedge member for connecting said sounding board means to a frame or casing member of said instrument.

5. A musical instrument as defined in claim 4, further including a back post and wherein said wedge member connects said sounding board means to said back post of said instrument.

6. A musical instrument as defined in claim 1, wherein said sounding board means further includes a crown and one to three strengthening rib members for maintaining said crown of said sounding board means.

7. In an acoustic stringed musical instrument, a method for increasing the loudness and slower decay rate, said method including the steps of:

providing a sounding board having at least two edges which are in major part unconfined and free to vibrate by a bridge mounted on a first face of said sounding board in response to activation by string vibrations to a greater loudness and slower decay rate as a result of said unrestrained pair of edges, providing a wedge member centrally of said sounding board for pressing against the sounding board and securing said sounding board to a back post of said instrument, and providing to a second face surface of said sounding board opposite to said first face of the sounding board fewer than four strengthening rib members.

8. An improvement as defined in claim 7 wherein said instrument comprises a piano, the means for selectively activating said strings comprising a plurality of hammer means.

9. An improvement as defined in claim 7 wherein said instrument comprises a harpsichord, the means for selectively activating said strings being a plurality of means for plucking said strings.

* * * * *